US007988791B2

(12) United States Patent
Delgado

(10) Patent No.: US 7,988,791 B2
(45) Date of Patent: Aug. 2, 2011

(54) DISHWASHER WITH MULTIPLE WASH ZONES

(75) Inventor: Kristopher Lee Delgado, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 555 days.

(21) Appl. No.: 12/013,489

(22) Filed: Jan. 14, 2008

(65) Prior Publication Data

US 2009/0178698 A1 Jul. 16, 2009

(51) Int. Cl.
*B08B 3/00* (2006.01)

(52) U.S. Cl. ..... 134/56 D; 134/57 D

(58) Field of Classification Search ..... None
See application file for complete search history.

(56) References Cited

U.S. PATENT DOCUMENTS

| | | | | |
|---|---|---|---|---|
| 1,720,332 | A | 7/1929 | Kehoe, Jr | |
| 3,067,759 | A | 12/1962 | Guth et al. | |
| 3,319,640 | A | 5/1967 | Flame | |
| 3,915,182 | A | 10/1975 | Payne | |
| 5,031,651 | A * | 7/1991 | Spiegel et al. | 134/183 |
| 6,325,083 | B1 | 12/2001 | Worter | |
| 2005/0051201 | A1 * | 3/2005 | Ashton et al. | 134/104.1 |

FOREIGN PATENT DOCUMENTS

| | | | |
|---|---|---|---|
| DE | 4010066 | A1 | 10/1991 |
| DE | 4018048 | A1 | 12/1991 |
| DE | 19736917 | A1 * | 3/1999 |
| DE | 19840291 | A1 | 3/2000 |
| DE | 10121083 | A1 | 10/2002 |
| EP | 0053231 | A1 | 6/1982 |
| EP | 0534213 | A1 | 3/1993 |
| EP | 1238622 | A2 | 9/2002 |
| EP | 1252856 | A2 | 10/2002 |
| FR | 2442618 | | 6/1979 |

OTHER PUBLICATIONS

Steiner et al., Mar. 1999, DE 19736917A1, English machine translation.*

* cited by examiner

*Primary Examiner* — Michael Barr
*Assistant Examiner* — Jason Y Ko
(74) *Attorney, Agent, or Firm* — Robert A. Bacon; McGarry Bair PC

(57) ABSTRACT

An automatic dishwasher, comprises a wash chamber, a rotating spray arm having an outer periphery or rotation and having at least one outlet for introducing a stream of liquid into the wash chamber, a disperser located within the wash chamber and exteriorly of the outer periphery of the rotating spray arm where during at least a portion of one revolution of the rotating spray arm the disperser is fluidly connected such that the stream of liquid is transferred to the disperser, and a liquid volume controller to control the volume of liquid transferred from the rotating spray arm to the disperser. Wherein the disperser provides an additional source of water spray to utensils in the wash chamber and the liquid volume controller controls the amount of such additional spray.

9 Claims, 7 Drawing Sheets

DISHWASHER WITH MULTIPLE WASH ZONES

BACKGROUND OF THE INVENTION

Contemporary dishwashers include a tub defining a wash chamber within which is provided a rack for holding dishes. Typically, there is an upper and lower rack or basket for supporting soiled utensils within the tub. A pump is provided for re-circulating wash liquid throughout the tub to remove soils from the utensils. Rotating spray arms are typically positioned beneath each rack and are supplied liquid from the pump, which effects the rotation of the arm as it is sprayed onto the rack.

One problem associated with contemporary dishwashers is that the utensils may not receive uniform wash treatment depending upon their positioning within a rack in the dishwasher. The rotating arms rotate in a plane about a vertical axis and define a circular outer periphery of the wash arms wherein the majority of the wash liquid is sprayed. The racks tend to be rectangular, which results in the corners of the racks lying beyond the outer periphery where they receive a less uniform wash.

SUMMARY OF THE INVENTION

The invention provides for an automatic dishwasher with a wash chamber for receiving utensils to be washed. The wash chamber also houses a rotating spray arm having a longitudinal axis and at least one outlet for introducing a stream of liquid into the wash chamber and rotating about a rotational axis with the longitudinal axis defining a plane of rotation having an outer periphery. The wash chamber also houses a disperser that is located exteriorly of the outer periphery and in alignment with the stream of liquid during at least for a portion of one revolution of the spray arm such that the liquid is transferred to the disperser for dispersing of the liquid in the wash chamber at least in an area beyond the outer periphery.

DESCRIPTION OF EMBODIMENTS OF THE INVENTION

Figure 1:
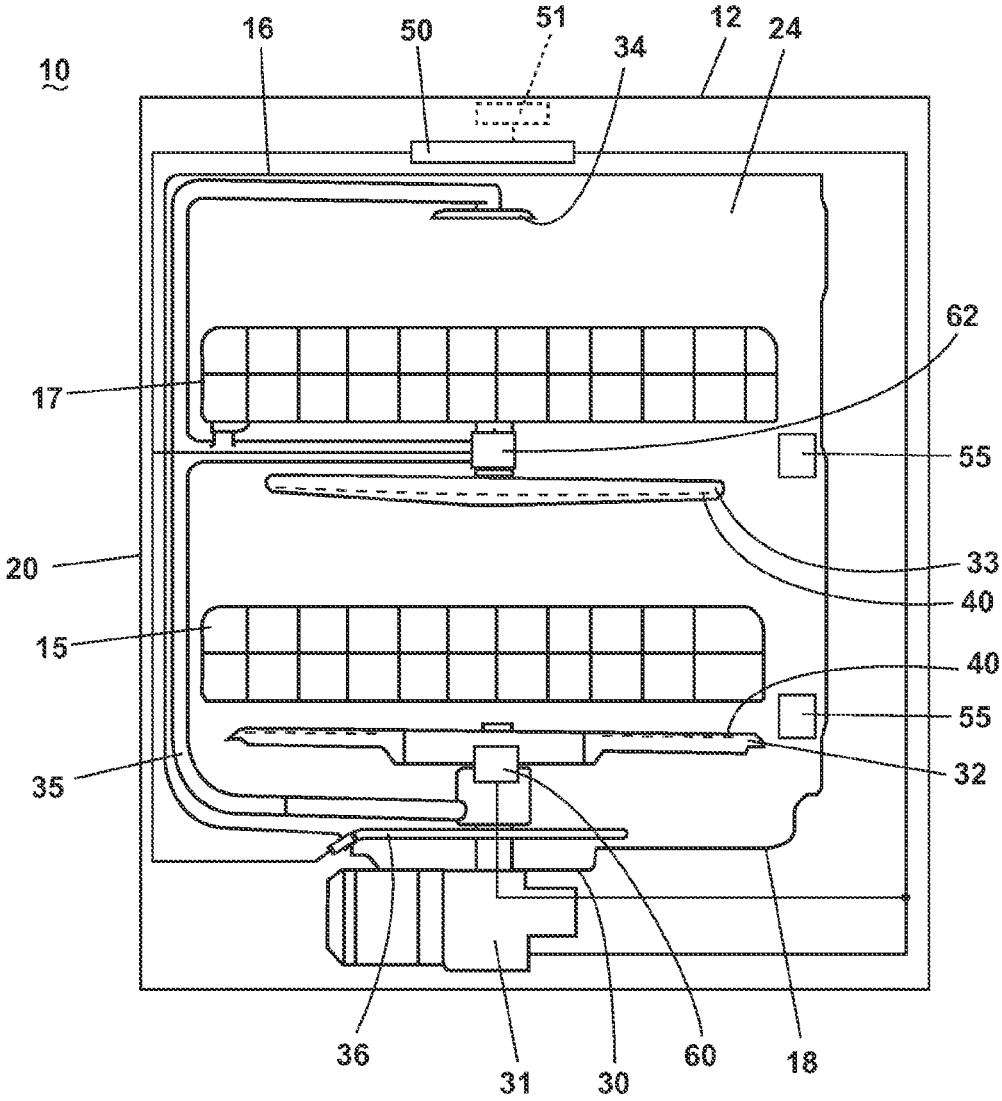
FIG. 1 is a schematic view of a dishwasher according to the invention with wash chamber, upper and lower racks, disperser, and liquid volume controller.

Referring now to FIG. 1 an embodiment of the invention is illustrated comprising an automated dishwasher 10 having a housing 12. The dishwasher 10 shares many features of a conventional automated dishwasher, which will not be described in detail herein except as necessary for a complete understanding of the invention. The housing 12 has spaced top and bottom walls 16 and 18, and spaced side walls 20. The walls 16, 18, and 20 join along their respective edges to define a wash chamber 24. The front wall may be the door of the dishwasher 10, which may be pivotally attached to the dishwasher 10 for providing accessibility to the wash chamber 24 for loading and unloading utensils or other washable items. While the present invention is described in terms of a conventional dishwashing unit as illustrated in FIG. 1, it could also be implemented in other types of dishwashing units such as in-sink dishwashers or drawer dishwashers.

Utensil holders in the form of upper and lower racks 15, 17 are located within the wash chamber 24 and receive utensils for washing. The upper and lower racks 15, 17 are typically mounted for slidable movement in and out of the wash chamber 24 for ease of loading and unloading. As used in this description, the term utensil is generic to dishes and the like that are washed in the dishwasher 10 and expressly includes, dishes, plates, bowls, silverware, glassware, stemware, pots, pans, and the like.

The bottom wall 18 of the dishwasher may be sloped to define a lower tub region or sump 30 of the tub. A pump assembly 31 may be located in or around a portion of the bottom wall 18 and in fluid communication with the sump 30 to draw wash liquid from the sump 30 and to pump the liquid to at least a rotating lower spray arm assembly 32. If the dishwasher has a mid-level spray arm assembly 33 and/or an upper spray arm assembly 34, liquid may be selectively pumped through a supply tube 35 to each of the assemblies for selective washing.

In this embodiment, the rotating lower spray arm assembly 32 is positioned beneath a lower utensil rack 15, the mid-level spray arm assembly 33 is positioned between an upper utensil rack 17 and the lower utensil rack 15, and the upper spray arm assembly 34 is positioned above the upper utensil rack 17. The rotating lower spray arm assembly 32 is configured to rotate in the tub and spray a flow of wash liquid from at least one outlet 40, in a generally upward direction, over a portion of the interior of the tub. The spray from the rotating lower spray arm assembly 32 is typically directed to wash utensils located in the lower rack 15. Like the rotating lower spray arm assembly 32, the mid-level spray arm assembly 33 may also be configured to rotate in the dishwasher 10 and spray a flow of wash liquid from at least one outlet 40, in a generally upward direction, over a portion of the interior of the tub. In this case, the spray from the mid-level spray arm assembly 33 is directed to utensils in the upper utensil rack 17. Referring again to FIG. 1, in contrast, the upper spray arm assembly 34 generally directs a spray of wash water in a generally downward direction and helps wash utensils on both utensil racks 15, 17.

The pump assembly 31, spray arm assemblies 32-34 and supply tube 35 collectively form a liquid recirculation system for spray liquid within the wash chamber 24. The pump draws liquid from the sump 30 and delivers it to one or more of the spray arm assemblies 32-34 through the supply tube 35, where the liquid is sprayed back into the wash chamber 24 through the spray arm assemblies 32-34 and drains back to the sump 30 where the process is repeated. While the spray arm assemblies 32 and 33 are illustrated as rotating spray arms and upper spray arm assembly 34 is illustrated as a fixed spray head, the spray arm assemblies can be of any structure and configuration.

A heater 36 is located within the sump for heating the water contained in the sump. A controller 50 is operably coupled to the pump assembly 31 and heater 36 and controls the operation of the pump assembly 31 and heater 36 to implement the selected cycle. The controller 50 may comprise a user interface enabling the user to select the desired wash cycle and set correspondingly relevant parameters or options for the cycle. A control panel 51, shown in phantom, may be coupled to the controller 50 and may provide for input/output to/from the controller 50. The control panel may be any suitable input/output device, such as a touch panel, switches, knobs, displays, indicators, etc., and any combination thereof.

This embodiment further comprises at least one disperser 55 located inside the wash chamber 24 and attached to at least one of the spaced side walls 20. A liquid volume controller 60 and a second liquid volume controller 62 are illustrated as being located inside the wash chamber 24 and operably coupled with the controller 50. The liquid volume controller 60 controls the volume of liquid transferred from the rotating lower spray arm assembly 32 to the disperser 55. The second liquid volume controller 62 controls the volume of liquid transferred from the rotating mid-level spray arm assembly 33 to the disperser 55. The liquid volume controllers 60, 62 may be configured to selectively divert a stream of wash liquid from at least one outlet 40 of the rotating spray arm assemblies 32, 33 to the dispersers 55.

The liquid volume controller 60 may selectively divert the stream of liquid in any manner of ways. The liquid volume controller 60 may be a motor that controls the rotation speed of the rotating lower spray arm assembly 32. Such a rotational controller may slow the rotating lower spray arm assembly 32 as the stream of liquid from the rotating lower spray arm assembly 32 passes by the disperser 55. The liquid volume controller 60 may also stop the rotating lower spray arm assembly 32 for a period as the stream of liquid is fluidly coupled with the disperser 55. The liquid volume controller may be operably coupled with the pump assembly 31. In this manner, the liquid volume controller may increase or decrease the amount of liquid provided to the rotating lower spray arm assembly 32 as the stream of liquid from at least one outlet 40 of the rotating lower spray arm assembly 32 passes the disperser 55. Using the liquid volume controller to control a variable speed pump may simultaneously slow the speed of the rotating lower spray arm assembly 32 and slow the volume of the stream of liquid being transferred to the disperser 55. Further, at some stop point friction from the rotating lower spray arm assembly 32 overcomes the rotation force provided by the variable speed pump. At this stop point, the rotating lower spray arm assembly 32 may still provide a stream of liquid but will stand still and not rotate.

Figure 2:
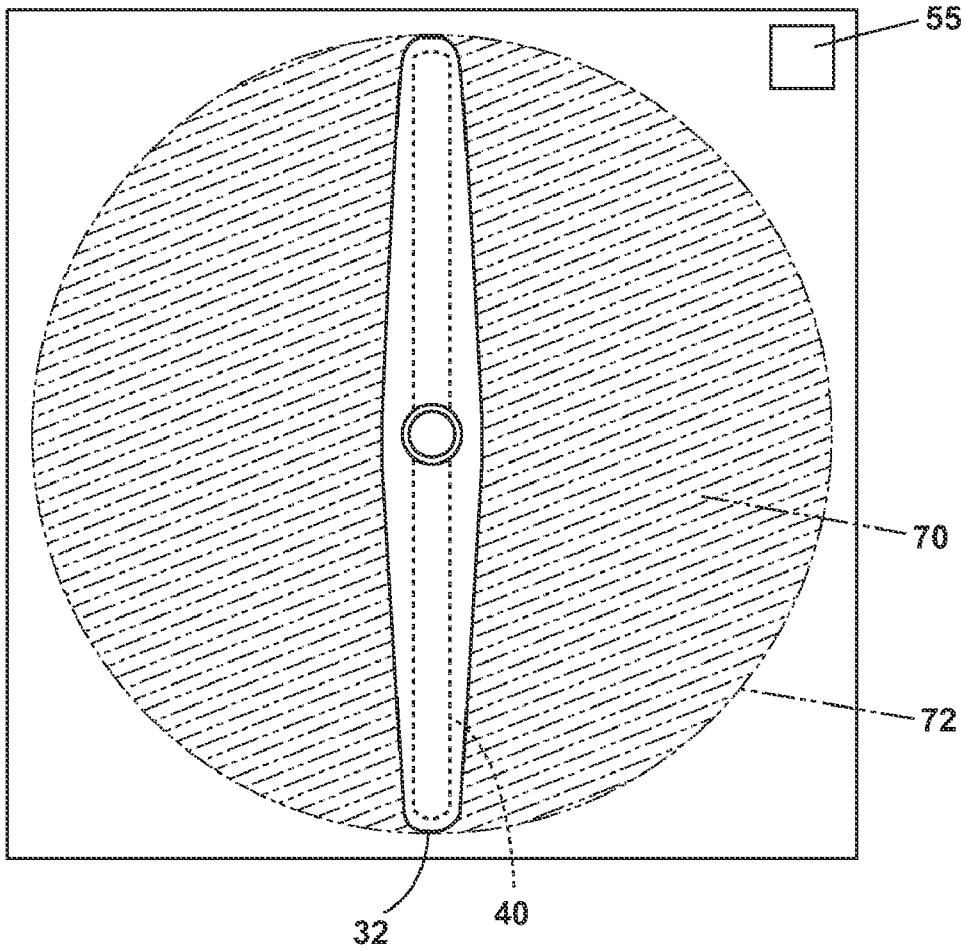
FIG. 2 is a top view of the dishwasher showing the spray arm, its plane of rotation and outer periphery and the disperser.

Both rotating spray arms 32, 34 have a longitudinal axis and rotate about a rotational axis, with the longitudinal axis defining a plane of rotation having an outer periphery. FIG. 2 shows such a plane of rotation 70 and its outer periphery 72. This outer periphery 72 does not include sections of the wash chamber 24 (such as the corners). In this embodiment, the disperser 55 is located beyond the outer periphery 72 formed by the rotating lower spray arm assembly 32. Although much of the remainder of this application is directed to the embodiment focused upon the rotating lower spray arm assembly 32, the invention may be used in connection with the rotating mid-level spray arm assembly 33, the upper spray arm assembly 34 or any additional spray assemblies. The disperser 55 is located in the wash chamber 24 such that at some point during one revolution of the rotating lower spray arm assembly 32 through the plane of rotation 70 the rotating lower spray arm assembly 32 and the disperser 55 are fluidly coupled. The disperser 55 may be fixed to the tub of the wash chamber 24 and configured to provide a second flow of wash liquid over a portion, or several portions, of the interior of the wash chamber 24. In essence, a stream of liquid is transferred from at least one outlet 40 of the rotating lower spray arm assembly 32 to the disperser 55 and then to another portion of the wash chamber 24. This additional liquid may create a separate wash zone or an intensified wash zone in the wash chamber 24.

Figure 3:
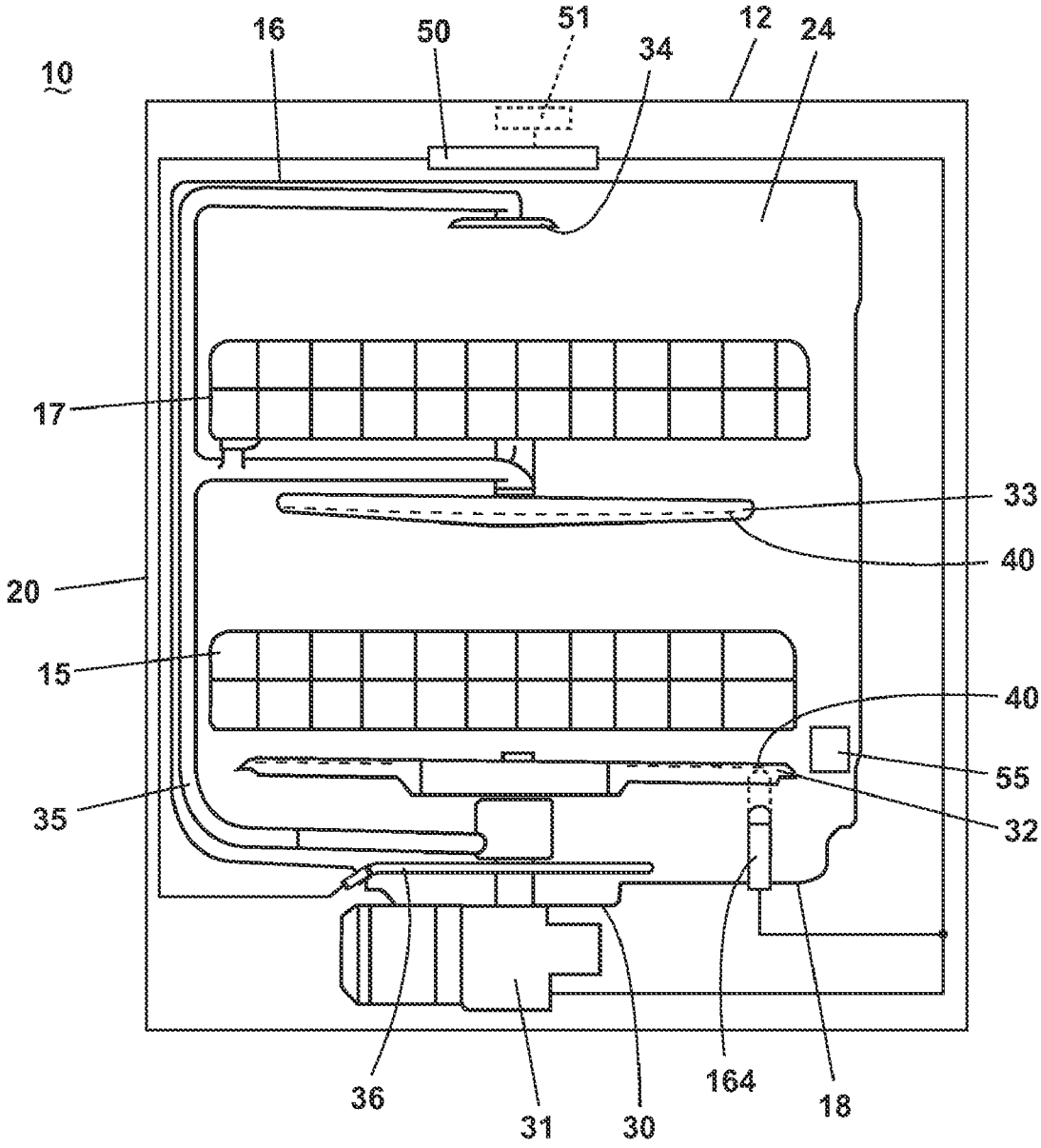
FIG. 3 is a schematic view of a second embodiment of the liquid volume controller of the invention.
Figure 4:
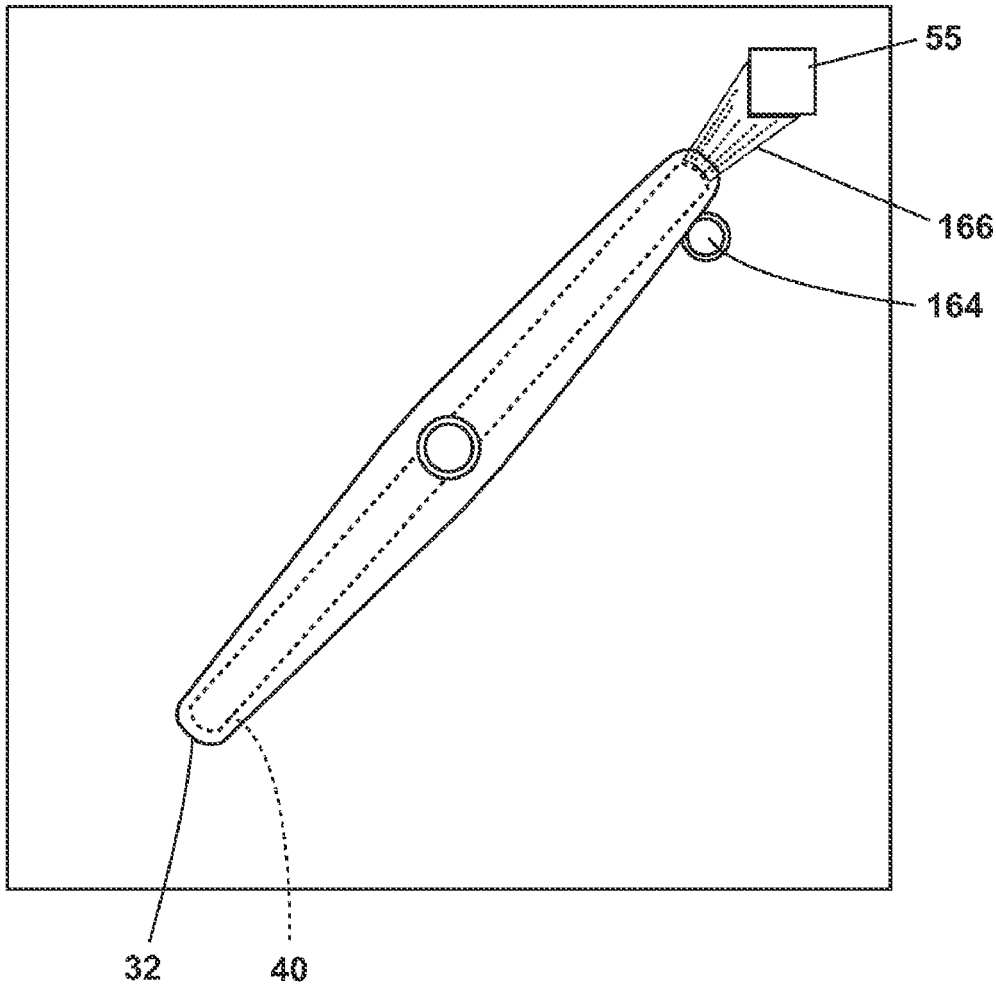
FIG. 4 is a top view of the liquid volume controller of FIG. 3.

Other liquid volume controllers according to the invention have been contemplated. A second embodiment of the liquid volume controller is depicted in FIGS. 3 and 4, wherein the liquid volume controller is a stop mechanism 164. This stop mechanism 164 may be located beneath a portion of the rotating lower spray arm assembly 32. When the controller 50 signals the stop mechanism 164 the stop mechanism 164 may extend itself such that it is located in the plane of rotation 70 of the rotating lower spray arm assembly 32. The extended stop mechanism 164 obstructs further rotation of the rotating lower spray arm assembly 32 until the stop mechanism 164 is retracted by a signal from the controller 50. FIG. 4 shows that the stop mechanism 164 contacts the rotating lower spray arm assembly 32 when the stream of liquid 166 is fluidly coupled with the disperser 150.

During operation of the dishwasher 10, the liquid volume controller may be employed to control and increase the volume of the stream of liquid from the rotating lower spray arm assembly 32 to the disperser 55 for creating an additional flow of wash liquid into another portion of the wash chamber 24. When time comes to increase the volume of liquid to the disperser 55, the controller 50 signals the liquid volume controller 60, which may in turn control a motor, a pump assembly, or a stop to supply an increased volume of liquid to the disperser and any accompanying sprayers or conduits. The controller 50 sends a signal to the liquid volume controller 60 to selectively or incrementally control the discharging of the desired amount of the stream of liquid fluidly coupling the disperser 55.

Figure 5:
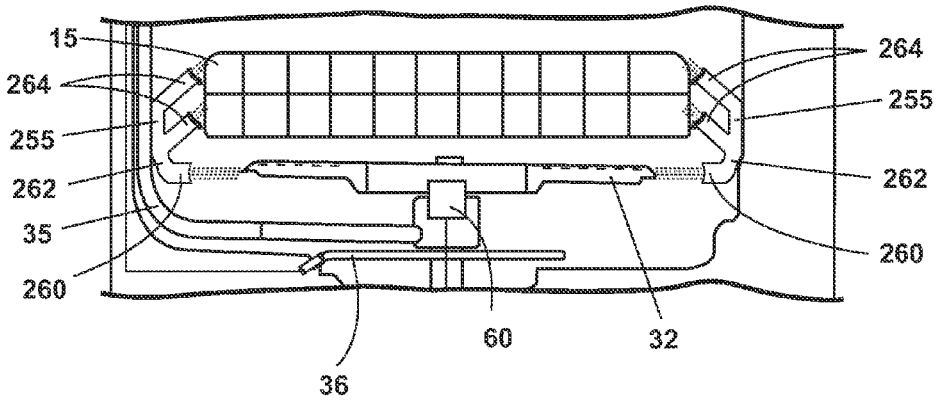
FIG. 5 is a side schematic view of a third embodiment of the invention.

FIG. 5 is a third embodiment of the invention and comprises a liquid volume controller 60 and multiple dispersers in the form of manifolds. The spray manifold 255 is configured to have one spray manifold inlet 260, a spray manifold chamber 262 which may be filled with liquid and at least one spray manifold outlet 264 configured to spray wash liquid into the interior of the wash chamber 24. The stream of liquid from the rotating lower spray arm assembly 32 will be under pressure as it passes through the spray manifold inlet 260, into the spray manifold chamber 262 and out at least one spray manifold outlet 264. As water passes through the spray manifold inlet 260 the spray manifold chamber 262 is filled by the stream of liquid during successive rotations of the rotating lower spray arm assembly 32. Once the spray manifold chamber 262 is filed additional water introduced into the spray manifold inlet 260 will produce a liquid stream out of at least one spray manifold outlet 264. While not shown, a check valve can be placed at the spray manifold inlet 260 to stop the back flow of water from the spray manifold 255.

As illustrated in the embodiment in FIG. 5, additional liquid streams are achieved by selectively diverting the stream of liquid from the rotating lower spray arm assembly 32 to a spray manifold 255 positioned on the interior wash chamber 24 adjacent the lower utensil rack 15. Multiple spray manifolds 255 are depicted although any number may be used. In this way, at least one additional stream of wash liquid is directed toward the lower utensil rack 15 from the spray manifold 255 thereby providing an additional wash zone. The spray manifold 255 is not limited to this position, rather, the spray manifold 255 could be located in virtually any part of the interior wash chamber 24. For example, the spray manifold 255 could be moved up vertically along any portion of the interior wash chamber 24 such as to a position adjacent the upper utensil rack 17. The spray manifold 255 may also have other configurations including a larger chamber or a variety of different outlets. In this third embodiment, the spray manifold 255 is in fluid communication with the stream of liquid provided by at least one outlet 40 of the rotating lower spray arm assembly 32 such that wash liquid may be selectively provided to the spray manifold 255.

Figure 6:
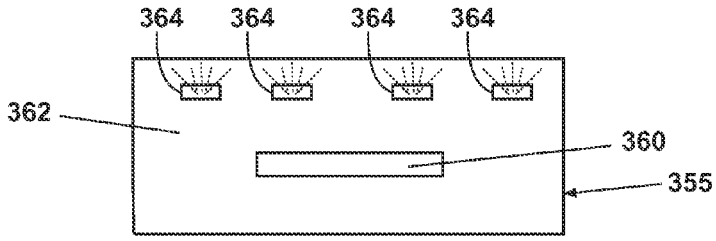
FIG. 6 is a schematic view of a fourth embodiment of the invention.

FIG. 6 is a fourth embodiment of the invention and illustrates a front view of a spray manifold 355. The spray manifold 355 is configured to have one inlet 360, a chamber 362 which may be filled with liquid and at least one outlet 364 configured to spray wash liquid into the interior of the wash chamber 24. The stream of liquid from the rotating lower spray arm assembly 32 will be under pressure as it passes through the inlet 360 into the chamber 362 and out at least one outlet 364. As water passes through the inlet 360, the chamber 362 is filled by the stream of liquid during successive rotations of the rotating lower spray arm assembly 32. While not shown, a check valve can be placed at the spray manifold inlet 360 to stop the back flow of water from the spray manifold 355. Once the chamber 362 is filed additional water introduced into the inlet 360 will produce liquid streams out of at least one outlet 364.

Figure 7:
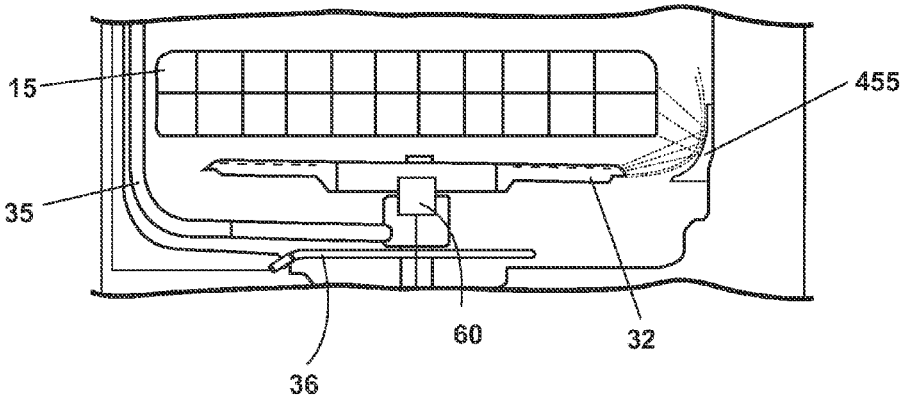
FIG. 7 is a side schematic view of a fifth embodiment of the invention.

FIG. 7 is a fifth embodiment of the invention and comprises a liquid volume controller 60 and a disperser in the form of a deflector 455. The deflector 455 is configured to have an angular surface configured to spray wash liquid into additional portions of the interior of the wash chamber 24. The stream of liquid from the rotating lower spray arm assembly 32 will be under pressure as it contacts the deflector 455. The deflector 455 will divert the stream of liquid from its original path to form an additional liquid stream and an additional wash zone. The additional liquid streams are achieved by selectively diverting the stream of liquid from the rotating lower spray arm assembly 32 to a deflector 455 positioned on the interior wash chamber 24 adjacent the lower utensil rack 15. In this way, an additional stream of wash liquid is directed toward the lower utensil rack 15 from the deflector 455 thereby providing an additional wash zone. The deflector 455 is not limited to this position, rather, it could be located in virtually any part of the interior wash chamber 24. Further, any number of deflectors could be used in any configuration desired. For example, the deflector 455 could be moved into the corner of the wash chamber to provide an additional wash zone in the corner of the lower utensil rack 15.

Figure 8:
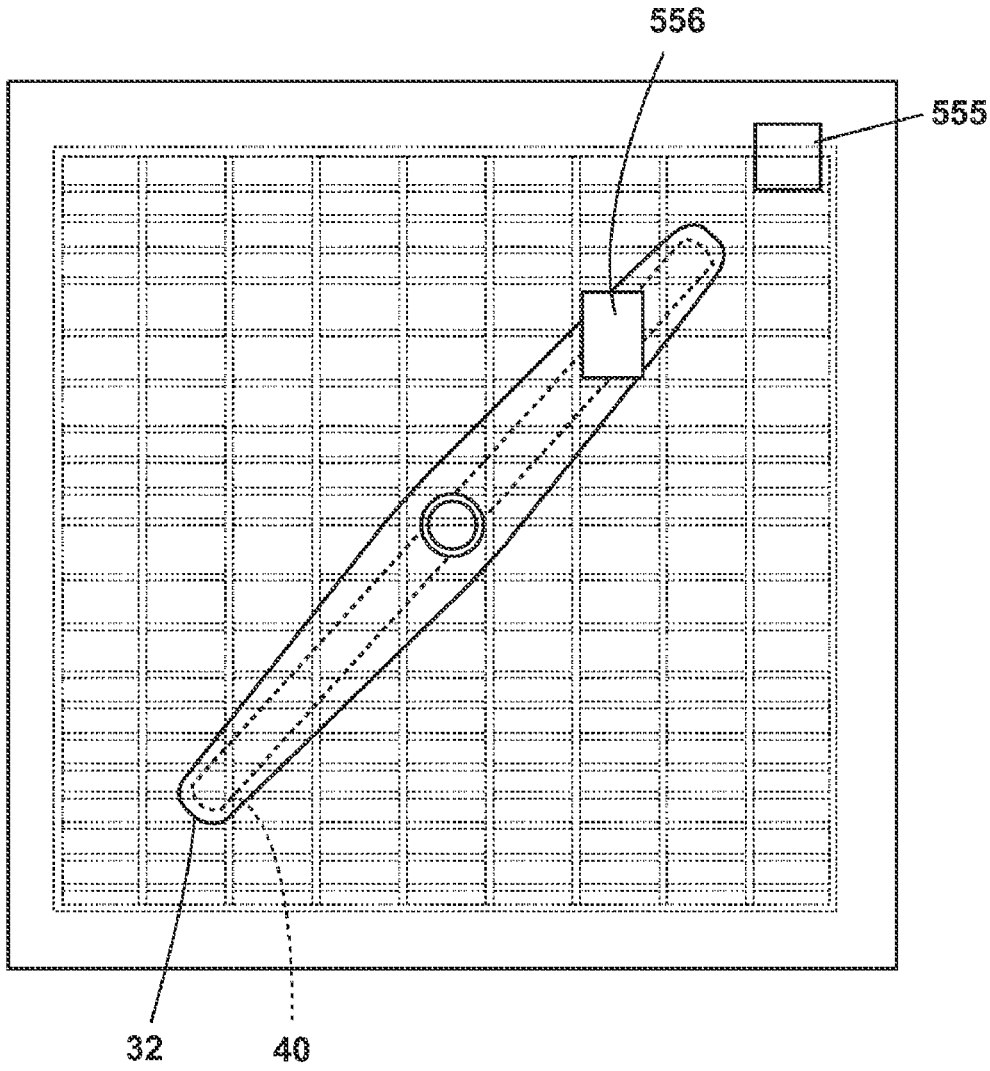
FIG. 8 is a top schematic view of a sixth embodiment of the invention.

The disperser of the invention may differ from the configuration shown in FIGS. 1-7, such as by inclusion of other manifolds, conduits, dispersers, deflectors, liquid volume controllers, and the like, to control the flow of the stream of liquid from the rotating spray arms to create other flows of wash liquid and provide the liquid to other sections of the interior wash chamber 24. For example, FIG. 8 is a sixth embodiment of the invention wherein the disperser 555 is located inside the wash chamber 24 and exteriorly of the outer periphery 72 formed by the rotating lower spray arm assembly 32. The disperser is located in the wash chamber 24 such that at some point during one revolution of the rotating lower spray arm assembly 32 through the plane of rotation 70 the rotating lower spray arm assembly 32 and the disperser 555 are fluidly coupled. The disperser may be fixed to the tub of the wash chamber 24 and configured to provide a second flow of wash liquid over a portion, or several portions, of the interior of the wash chamber 24. A second disperser 556 may be located above or below the plane of rotation of the rotating lower spray arm assembly 32 but internal to its outer periphery 72. This second disperser 556 may be attached to the lower utensil rack 15 and may be configured such that the rotating lower spray arm assembly 32 and the second disperser 556 are fluidly coupled one or multiple times during one revolution of the rotating lower spray arm assembly 32. One or several streams of liquid may be transferred from the rotating lower spray arm assembly 32 to the second disperser 556 and then to another portion or portions of the wash chamber 24.

Figure 9:
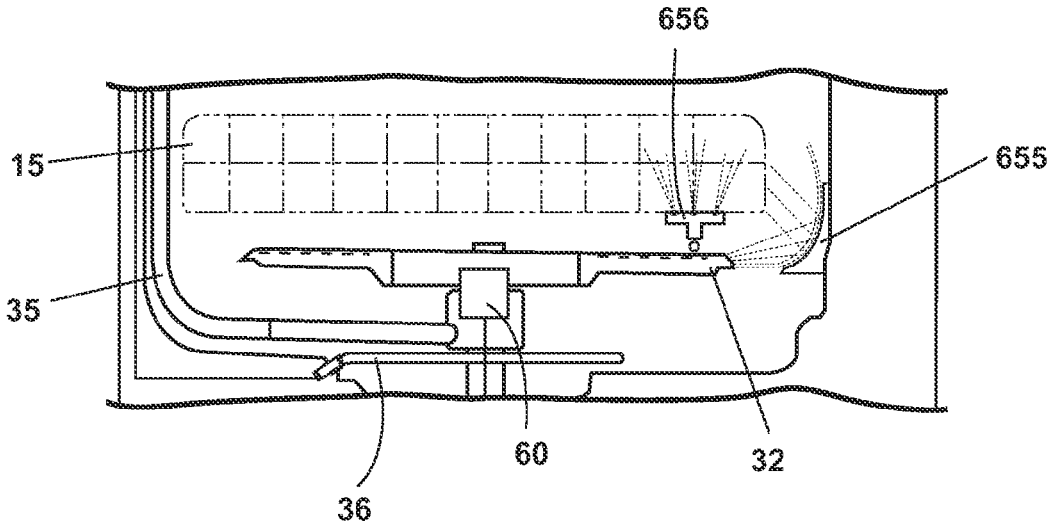
FIG. 9 is a side schematic view of a seventh embodiment of the invention.

FIG. 9 depicts a seventh embodiment comprising a liquid volume controller 60 and a first disperser, a deflector 655, is located in the plane of rotation of the rotating lower spray arm assembly 32 but outside its outer periphery. The embodiment further comprises a second disperser, a manifold 656, attached to the bottom of the lower utensil rack and located above the plane of rotation of the rotating lower spray arm assembly 32 but interior to its outer periphery. The manifold 656 is depicted as having one inlet and multiple outlets that carry the stream of liquid from the rotating lower spray arm assembly 32 to various other portions of the interior wash chamber 24. These additional streams of liquid may be used to provide liquid to areas outside the outer periphery 72 of the rotating lower spray arm assembly 32 or to intensify the volume of liquid in one particular area of the wash chamber 24. This intensified volume of water may create a zone of intensified wash performance and be used to improve the wash performance of highly soiled utensils.

While the invention has been specifically described in connection with certain specific embodiments thereof, it is to be understood that this is by way of illustration and not of limitation, and the scope of the appended claims should be construed as broadly as the prior art will permit.

What is claimed is:

1. An automatic dishwasher comprising:

a tub at least partially defining a wash chamber;

at least one rack located within the wash chamber for receiving utensils to be washed;

a rotating spray arm located adjacent the at least one rack and having at least one outlet emitting liquid directly toward the at least one rack to define a first spray zone that is directed into the at least one rack, at least one other outlet emitting a stream of liquid along a first path away from the at least one rack and radially beyond a circle defined by an outermost point of the rotating spray arm over one revolution of the spray arm;

a disperser located within the wash chamber radially exterior of the circle and in direct alignment with the stream of liquid for at least a portion of one revolution of the rotating spray arm and where the stream of liquid is transferred from the at least one other outlet of the rotating spray arm to the disperser, and the disperser is configured to redirect the transferred stream of liquid onto a second path, different from the first path, toward the at least one rack to form a second spray zone directed to the at least one rack; and a liquid volume controller operably coupling the rotating spray arm and the disperser to control a volume of the stream of liquid that is transferred from the rotating spray arm to the disperser.

2. The automatic dishwasher according to claim 1, wherein the liquid volume controller comprises a rotational controller operably coupled to the rotating spray arm for controlling a speed of rotation of the rotating spray arm.

3. The automatic dishwasher according to claim 2, wherein the rotational controller reduces the speed of rotation of the rotating spray arm during at least a portion of time that the stream of liquid is aligned with the disperser.

4. The automatic dishwasher according to claim 3, wherein the rotational controller comprises a motor operably coupled to the spray arm.

5. The automatic dishwasher according to claim 3, wherein the rotational controller comprises a stop operably coupled with the spray arm to stop rotation of the spray arm when the stream is aligned with the disperser.

6. The automatic dishwasher according to claim 3, wherein the rotational controller comprises a pump operably coupled to the spray arm.

7. The automatic dishwasher according to claim 1, further comprising multiple dispersers located exteriorly of the circle.

8. The automatic dishwasher according to claim 1, further comprising at least one other disperser located above or below the circle.

9. The automatic dishwasher according to claim 1, wherein the disperser is mounted to the tub.

* * * * *